US009821924B2

(12) United States Patent
Schiebout

(10) Patent No.: US 9,821,924 B2
(45) Date of Patent: Nov. 21, 2017

(54) WEB PROCESSING WITH SEMI-ROTARY ACCUMULATOR

(71) Applicant: Delta Industrial Services, Inc., Minneapolis, MN (US)

(72) Inventor: David Schiebout, Brainerd, MN (US)

(73) Assignee: Delta Industrial Services, Inc., Minneapolis, MN (US)

( * ) Notice: Subject to any disclaimer, the term of this patent is extended or adjusted under 35 U.S.C. 154(b) by 25 days.

(21) Appl. No.: 14/951,889

(22) Filed: Nov. 25, 2015

(65) Prior Publication Data

US 2016/0083128 A1 Mar. 24, 2016

Related U.S. Application Data

(63) Continuation of application No. 14/033,019, filed on Sep. 20, 2013, now Pat. No. 9,216,866.

(51) Int. Cl.

| | |
|---|---|
| ***B65B 41/16*** | (2006.01) |
| ***B65G 13/04*** | (2006.01) |
| ***B65G 47/00*** | (2006.01) |
| ***B31B 1/00*** | (2006.01) |
| ***B65H 1/00*** | (2006.01) |
| ***B65H 20/34*** | (2006.01) |

(52) U.S. Cl.

CPC ..... *B65B 41/16* (2013.01); *B31B 1/00* (2013.01); *B65H 1/00* (2013.01); *B65H 20/34* (2013.01)

(58) Field of Classification Search

None

See application file for complete search history.

(56) References Cited

U.S. PATENT DOCUMENTS

| | | | | |
|---|---|---|---|---|
| 2,979,557 | A * | 4/1961 | Schroeder | G11B 15/14 386/204 |
| 3,850,213 | A * | 11/1974 | Keaton | B30B 5/06 100/154 |
| 3,902,376 | A | 9/1975 | Humphrey | |
| 5,281,030 | A | 1/1994 | Krnac | |
| 8,436,272 | B2 * | 5/2013 | Schiebout | B65H 19/00 219/121.6 |
| 9,216,866 | B2 | 12/2015 | Schiebout | |
| 2015/0083551 | A1 | 3/2015 | Schiebout | |

OTHER PUBLICATIONS

"U.S. Appl. No. 14/033,019, Non Final Office Action dated Apr. 28, 2015", 10 pgs.

"U.S. Appl. No. 14/033,019, Notice of Allowance dated Aug. 18, 2015", 6 pgs.

"U.S. Appl. No. 14/033,019, Response filed Jul. 28, 2014 to Non Final Office Action dated Apr. 28, 2015", 14 pgs.

* cited by examiner

*Primary Examiner* — Kavel Singh

(74) *Attorney, Agent, or Firm* — Schwegman Lundberg & Woessner, P.A.

(57) ABSTRACT

Various apparatus embodiments include first, second, third and fourth idler shafts, and further include a first movable idler shaft having a first movable axis that is movable between a first axis position and a second axis position, and a second movable idler shaft having a second movable axis that is movable between a third axis position and fourth axis position. At least one linkage connects the first movable idler shaft to the second movable idler shaft. A motor linkage connects the at least one linkage to at least one motor for providing simultaneous movement of the first and second movable idler shafts.

19 Claims, 11 Drawing Sheets

| | |
|---|---|
| PRE ACCUMULATOR LENGTH | 1.75 IN. |
| POST ACCUMULATOR LENGTH | 2.625 IN. |
| MATCH LENGTH | 1.5 IN. |

| START | ACCEL | MATCH LENGTH | DECEL | ACCEL | DECEL |
|---|---|---|---|---|---|
| 0 | 0.0937 | 1.5937 | 1.6874 | 2.1559 | 2.1559 MASTER POSITION (IN.) |
| 0 | 0.166666667 | 0.166666667 | 0 | -0.566666667 | 0 GEAR RATION |

WEB PROCESSING WITH SEMI-ROTARY ACCUMULATOR

PRIORITY

This application is a Continuation of U.S. patent application Ser. No. 14/033,019, filed Sep. 20, 2013; which application is incorporated herein by reference in its entirety.

TECHNICAL FIELD

This application relates generally to automated systems and methods for producing product, and more particularly to automated web processing systems such as web converting and packaging systems.

BACKGROUND

There are various automated systems and methods for producing product. By way of example, automated web converting systems may process material from different rolls of material to form product. The continuous rolls of material are fed as "webs" through web processing components to form a new product that may be an intermediate or final product. Converting processes may include coating, laminating, printing, die cutting, slitting, and the like.

A design goal for these automated systems may be to reduce material waste while maintaining a fast, accurate process. Thus, parts may be closely spaced in one web to reduce waste in the web, but may be required to be further spaced apart on a second web for further processing steps. An example of a system of providing such placement is a pick-and-place apparatus or an island placement apparatus. An example of an island placement apparatus is provided in U.S. Pat. Nos. 7,293,593 and 8,097,110, both entitled "Island Placement Technology."

SUMMARY

Various embodiments provided herein provide an apparatus for processing web that uses a semi-rotary accumulator to change web speed for transferring parts from a first web onto a second web. For example, a first web may run at a first speed entering a first web path through the semi-rotary accumulator. Operation of the semi-rotary accumulator may cause the web speed exiting the first web path within the accumulator to intermittently speed up and slow down. This variable speed web enters a second web path through the semi-rotary accumulator. Operation of the semi-rotary accumulator may transition the variable speed web motion entering the second web path back the first speed when exiting the second web path. A programmed cam motion profile may be used to control timing of the accumulator motion to provide a desired part placement on a second moving web.

An apparatus embodiment may comprise a first idler shaft, a second idler shaft, a third idler shaft, and a fourth idler shaft. The apparatus may further comprise a first movable idler shaft having a first movable axis that is movable between a first axis position and a second axis position, and a second movable idler shaft having a second movable axis that is movable between a third axis position and fourth axis position. At least one linkage connects the first movable idler shaft to the second movable idler shaft. A motor linkage is configured to connect the at least one linkage to at least one motor for providing simultaneous movement of the first and second movable idler shafts. Simultaneous movement of the first movable idler shaft toward the first axis position and the second movable idler shaft toward the third axis position increases a length of the first web path between the first and second idler shafts and decreases a length of the second web path between the third and fourth idler shafts. Simultaneous movement of the first movable idler shaft toward the second axis position and the second movable idler shaft toward the fourth axis position decreases the length of the first web path between the first and second idler shafts and increases the length of the second web path between the third and fourth idler shafts.

An apparatus embodiment may comprise first and second end supports, and first, second, third and fourth idler shafts extending between the first and second end supports. The first idler shaft may be configured to rotate about a first axis in a first fixed position, the second idler shaft may be configured to rotate about a second axis in a second fixed position, the third idler shaft may be configured to rotate about a third axis in a third fixed position, and the fourth idler shaft may be configured to rotate about a fourth axis in a fourth fixed position. The apparatus may further comprise first and second movable idler shafts extending between the first and second end supports, where the first movable idler shaft may be configured to rotate about a first movable axis that is movable between a first axis position and a second axis position, and the second movable idler shaft may be configured to rotate about a second movable axis that is movable between a third axis position and fourth axis position. A first web path length between the first idler shaft and the second idler shaft is longest when the first movable idler shaft is in the first axis position and shortest when the first movable idler shaft is in the second axis position. A second web path length between the third idler shaft and the fourth idler shaft is shortest when the second movable idler shaft is in the third axis position and longest when the second movable idler shaft is in the fourth axis position. A first linkage connects a first side of the first movable idler shaft to a first side of the second movable idler shaft, and a second linkage connects a second side of the second movable idler shaft to a second side of the second movable idler shaft. A motor linkage is configured to connect the first and second linkages to a motor to allow the motor to simultaneously move the first and second movable idler shafts in a first direction, and to simultaneously move the first and second movable idler shafts in a second direction opposite the first direction. The motor linkage may include a drive shaft extending between the first and second end supports where the drive shaft including a first drive shaft pulley proximate the first end support and a second drive shaft pulley proximate the second end support. A first belt is around the first drive shaft pulley and another pulley proximate the first end support. A second belt is around the second drive shaft pulley and another pulley proximate the second end support. A first linear bearing rail is mounted to the first end support. A cooperating first linear bearing block assembly is configured to linearly move along the first linear bearing rail and to connect the first belt to the first linkage. A second linear bearing rail is mounted to the second end support. A cooperating second linear bearing block assembly is configured to linearly move along the second linear bearing rail and to connect the second belt to the second linkage.

A method embodiment may comprise passing a web through a first web path within an apparatus in a first direction to a station, and passing the web from the station through a second web path within the apparatus in a second direction. Passing the web through the first web path may include passing the web past a first idler shaft with a first axis in a first fixed position, a first movable idler shaft with a first movable axis configured to be movable between a first axis position and a second axis position, and a second idler shaft with a second axis in a second fixed position. Passing the web from the station through the second web path may include passing the web past a third idler shaft with a third axis in a third fixed position, a second movable idler shaft with a second movable axis configured to be movable between a third axis position and a fourth axis position, and a fourth idler shaft with a fourth axis in a fourth fixed position. The method embodiment may intermittently decrease and increase speed of the web at the part transfer station, which may include simultaneously moving the first movable idler shaft toward the first axis position and the second movable idler shaft toward the third axis position to decrease speed of the web at the transfer station, and simultaneously moving the first movable idler shaft toward the second axis position and the second movable idler shaft toward the fourth axis position to increase speed of the web at the transfer station.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their equivalents.

DETAILED DESCRIPTION

Figure 6:
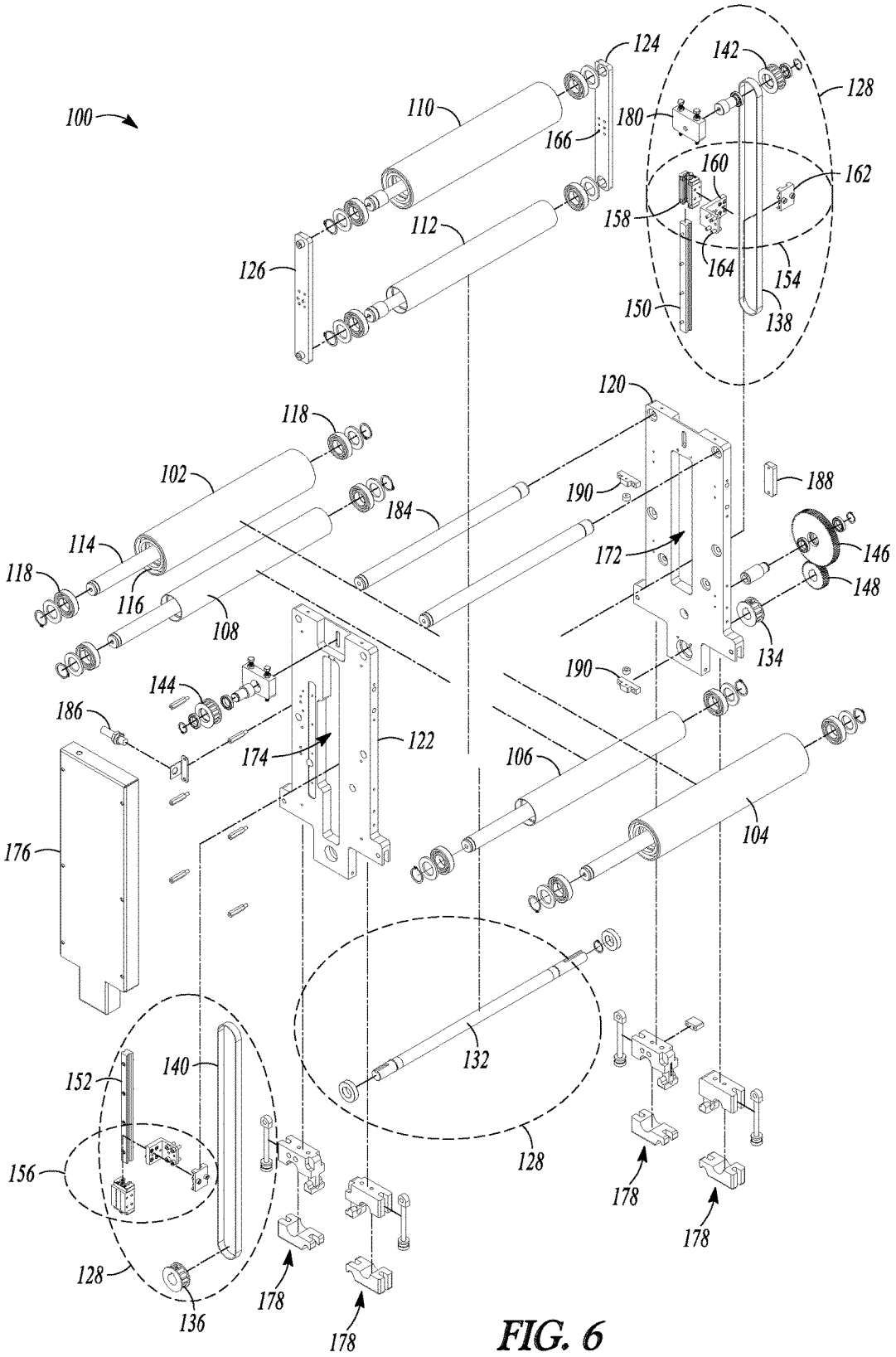
FIG. 6 illustrates an exploded view of the accumulator illustrated in FIG. 5.
Figure 7C:
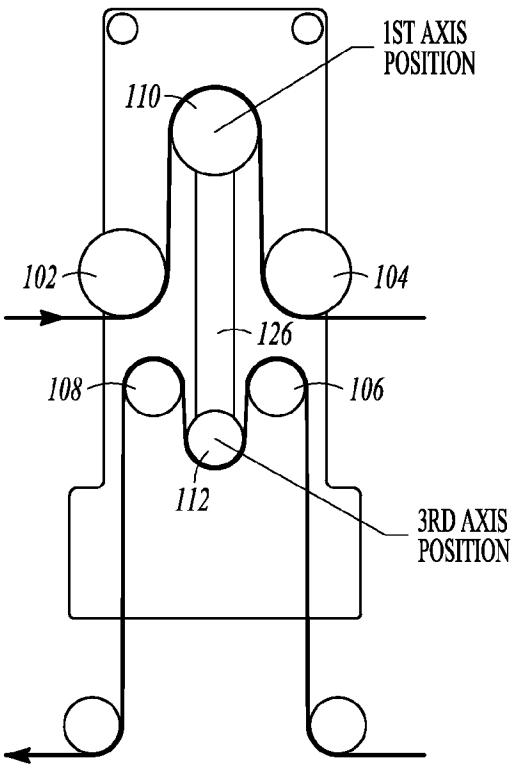
FIGS. 7A-7C illustrate web paths through the embodiment of the semi-rotary accumulator illustrated in FIG. 1 and further illustrate motion of the movable idlers shafts within the semi-rotary accumulator.
Figure 7B:
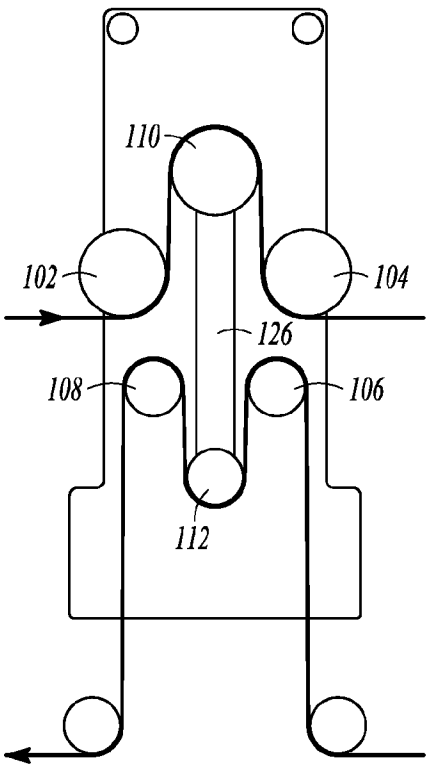
Figure 7A:
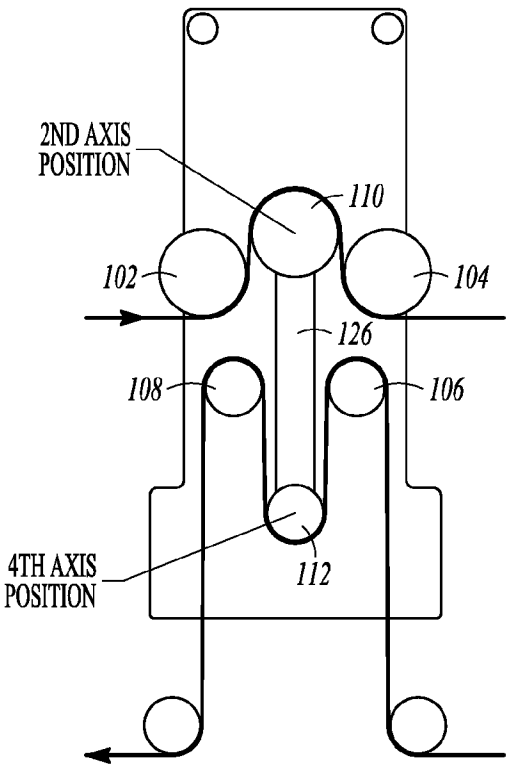

FIGS. 1-6 illustrate various views of an embodiment of a semi-rotary accumulator. The illustrated accumulator 100 includes a first idler shaft 102, a second idler shaft 104, a third idler shaft 106, and a fourth idler shaft 108. The apparatus 100 further includes a first movable idler shaft 110 shaft having a first movable axis that is movable between a first axis position and a second axis position, and a second movable idler shaft 112 having a second movable axis that is movable between a third axis position and fourth axis position, as is generally illustrated in FIGS. 7A-7C. Each of the idler shafts 102, 104, 106, 108, 110 and 112 has an axis along its shaft. Each of these idler shafts may be configured to freely rotate when a web passes by and in contact with the idler shaft. That is, the idler shafts do not rotate under their own power, but may easily rotate as the web passes through the web paths of the accumulator. For example, the illustrated idler shafts may have a center shaft 114, a cylindrical roll 116, and bearings 118 (illustrated as an example in FIG. 6 with respect to the first idler shaft 102) to allow the cylindrical roll to rotate around the center shaft. FIG. 6 also illustrates various hardware components for assembling the accumulator such as retaining rings, screws, bolts and washers and nuts, as will be understood by those of ordinary skill in the art. The idler shafts are illustrated as spanning or extending between a first and second end support 120 and 122. It is understood that, in addition to extending between the first and second end supports, the idler shafts may further extend past the first and/or second end support. Each of the first and second end supports may be configured with a plate-like structure and thus may be referred to as end plates. The first and second end supports will be described in more detail below. Some embodiments may use a cantilever design, and such cantilever embodiments may only use a signal end support.

The illustrated accumulator 100 further includes a first linkage 124 connecting a first side of the first movable idler shaft 110 to a first side of the second movable idler shaft 112, and a second linkage 126 connecting a second side of the first movable idler shaft 110 to a second side of the second movable idler shaft 112. The first and second linkages 124 and 126 function to maintain a fixed distance between the first and second movable idler shafts 110 and 112, and also function to maintain a parallel orientation of the first and second movable idler shafts 110 and 112 with respect to each other. The illustrated first and second linkages 124 and 126 between the first and second movable idler shafts 110 and 112 are mechanical linkages. Those of ordinary skill in the art will appreciate that the first and second movable idler shafts 110 and 112 may be electrically linked rather than mechanically linked. For example, each of the first and second movable idler shafts 110 and 112 may be controlled by its own motor, and each of these motors may be controlled to move the first and second movable idler shafts 110 and 112 together to maintain a fixed distance between them. The use of a linkage on each side of the movable idler shafts limits deflection in the idler shafts. However, some embodiments may implement a single linkage between the movable idler shafts 110 and 112.

The illustrated accumulator 100 further includes a motor linkage 128 illustrated generally in the exploded view of FIG. 6 configured to connect the first and second linkages 124 and 126 to a motor for providing simultaneous movement of the first and second movable idler shafts 110 and 112. The illustrated motor linkage 128 that has a drive shaft 132 including a first drive shaft pulley 134 proximate the first end support 120 and a second drive shaft pulley 136 proximate the second end support 122, a first belt 138 and a second belt 140. The first belt 138 is around the first drive shaft pulley 134 and a first stub pulley 142, and is connected to the first linkage 124. The second belt 138 is around the second drive shaft pulley 136 and a second stub pulley 144, and is connected to the second linkage 126. Operation of the motor drives gears 146 and 148 to cause the drive shaft 132 to rotate, and rotation of the drive shaft 132 moves the first and second belts 138 and 140, the first and second linkages 124 and 126, and the first and second movable idler shafts 110 and 112. As will be understood by those of ordinary skill in the art upon reading and comprehending this disclosure, the movable idler shafts 110 and 112 may be moved using designs without belts. For example, linear motors, ball screws, rack and pinion, mechanical cam and the like may be used to provide the motion of the movable idler shafts 110 and 112.

The illustrated accumulator 100 further includes a first and second linear bearing rails 150 and 152, and first and second linear bearing block assemblies 154 and 156. The first linear bearing rail 150 is mounted to the first end support 120 and the cooperating first linear bearing block assembly 154 is configured to linearly move along the first linear bearing rail 150. The first linear bearing block assembly 154 is configured to connect the first belt 138 to the first linkage 124. The second linear bearing rail 152 is mounted to the second end support 122 and the cooperating second linear bearing block assembly 156 is configured to linearly move along the second linear bearing rail 152. The second linear bearing block assembly 156 is configured to connect the second belt 140 to the second linkage 126. The illustrated linear bearing block assemblies include a linear bearing block 158 configured to ride on the linear bearing rail, and further includes a bracket 160 connected to the bearing block 158 and a clamp 162 configured to clamp the belt between the clamp 162 and the bracket 160. Furthermore, the linear bearing block assembly may be configured to extend into an opening in the side support to connect the linkage (e.g. 124 or 126). For example, the bracket 160 may be formed with pins 164 configured to fit in opening 166 within the linkage (e.g. 124) to cause the linkage to move with the belt.

The first end support 120 may include a first end plate with a first flat major surface 168, and the second end support 122 may include a second end plate with a second flat major surface 170 facing toward and substantially parallel with the first flat major surface. In the illustrated embodiment, each of the idler shafts is substantially perpendicular to the first and second flat major surfaces. Each of the first and second end plates includes an opening 172 and 174 configured to allow the bracket 160 to extend through the opening to connect with the linkages 124 and 126 and allow linear movement of the linkages 124 and 126 to simultaneously move the first movable idler shaft 110 and the second movable idler shaft 112 in the same direction.

The accumulator 100 may further include a front guard 176 configured to be attached to the second end support and cover the second belt and other moving parts proximate to the second end support. Additionally, the accumulator may include mounting clamps 178 for use to mount and clamp accumulator onto a web processing machine. For example, mounting rods may extend horizontally out from the web processing machine. The top portion of the mounting clamps may rest on the mounting rods, and the bottom portion may be clamped around the mounting rods to secure the accumulator in place. As illustrated, the accumulator 100 may also include belt tension adjustment blocks 180 to adjust tension in the drive belts. For example, threaded bolts 182 may be turned to screw into the block to increase tension in the belt, or may be turned to screw out of the block to decrease tension in the belt.

The accumulator may further include additional idlers on shaft 184 useful for providing desired web path into and out of the accumulator. Also, a sensor such as a proximity sensor 186 may be used to detect when the linear bearing block assembly is proximate to the sensor, for use in timing the motion of the first and second movable idler shafts 110 and 112. Other sensor(s) may be used to provide input for the larger web handling system. For example, a reflector 188 may be used to allow a sensor on the larger system to detect that the accumulator has been installed. Additionally, hard stops 190 may be used to limit motion under conditions such as a broken belt, a loss of motion profile, or an actuated emergency stop ("E-Stop").

Figure 1:
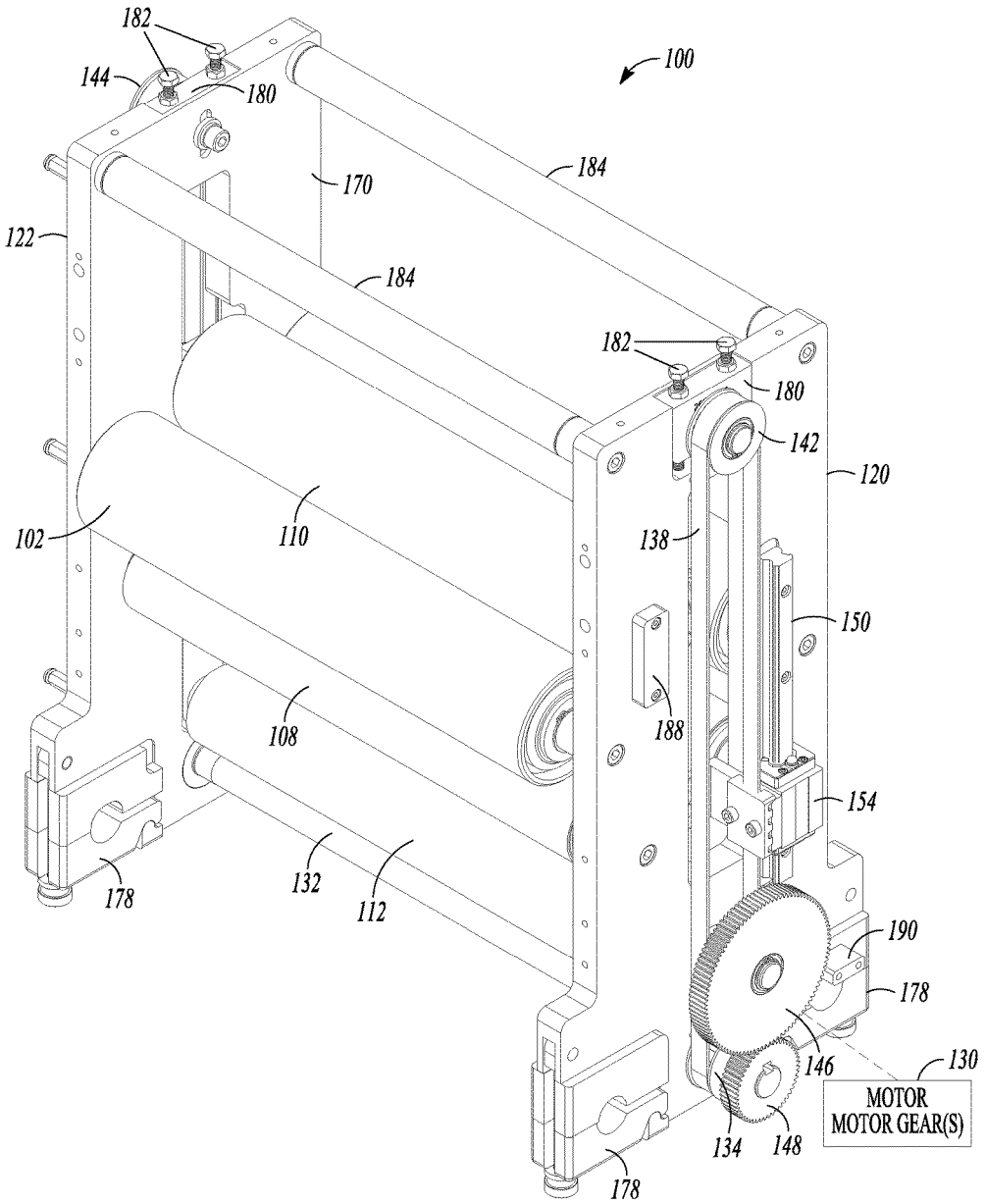
FIG. 1 illustrates a perspective rear view of an embodiment of a semi-rotary accumulator.
Figure 2:
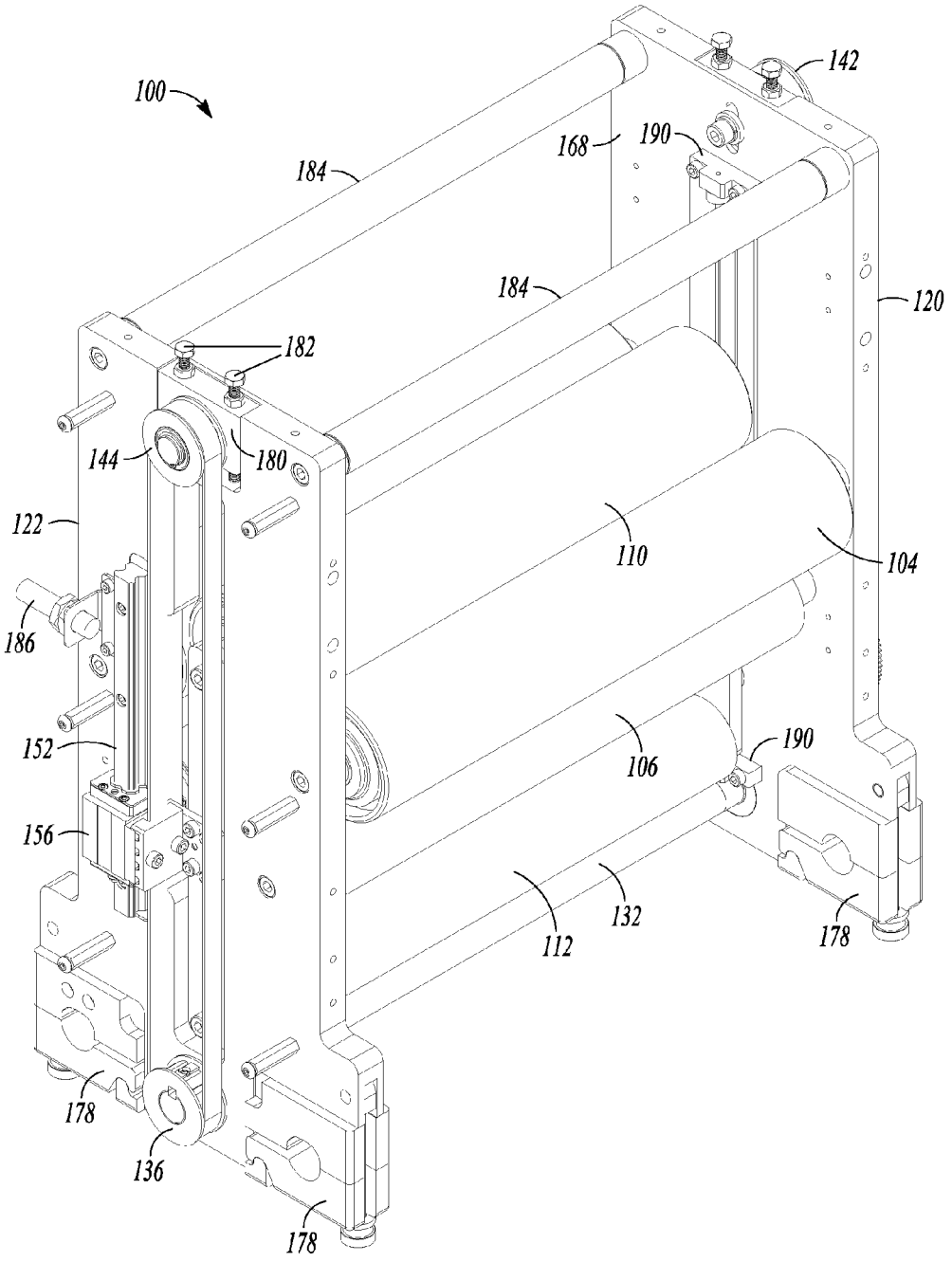
FIG. 2 illustrates a perspective front view of the embodiment of the accumulator illustrated in FIG. 1
Figure 4:
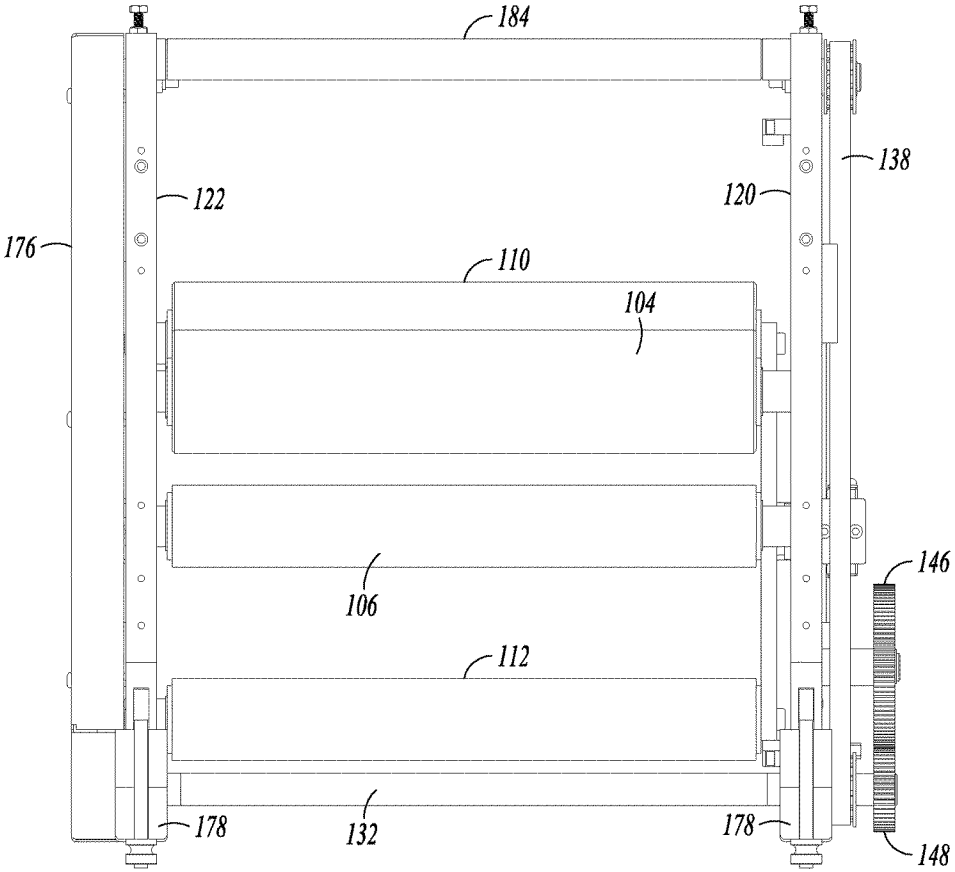
FIG. 4 illustrates a side planar view of the embodiment of the accumulator illustrated in FIG. 1 with an attached guard.
Figure 3:
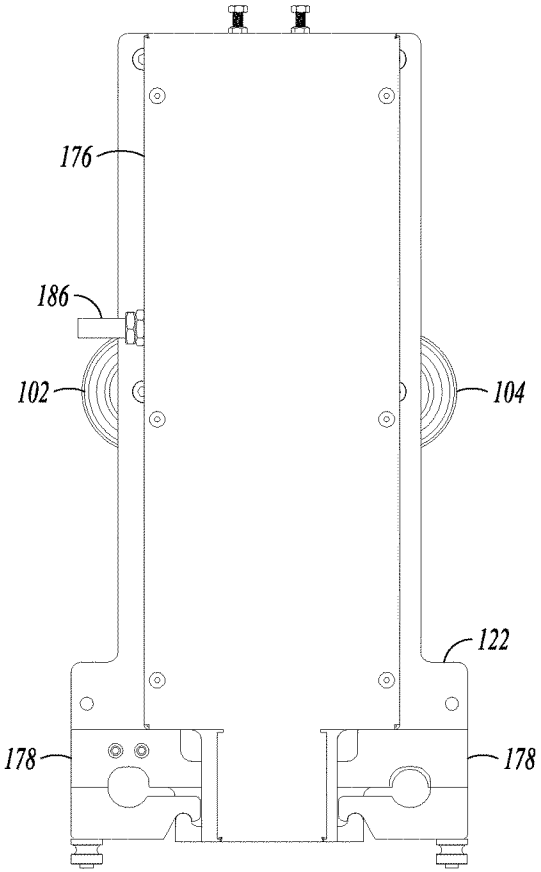
FIG. 3 illustrates a front planar view of the embodiment of the accumulator illustrated in FIG. 1 with an attached guard.
Figure 5:
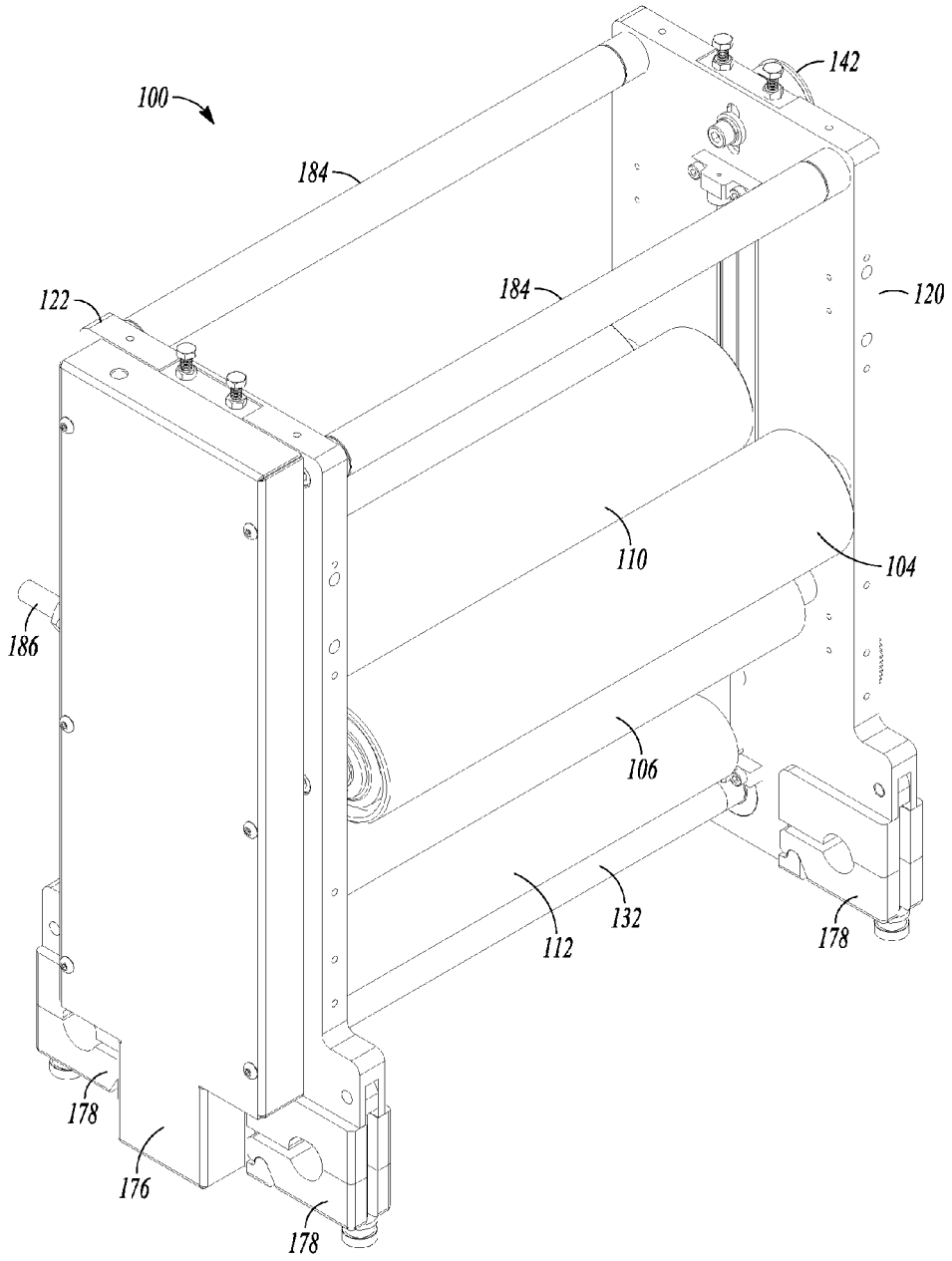
FIG. 5 illustrates the perspective front view of FIG. 2 with an attached guard.

FIGS. 7A-7C illustrate web paths through the embodiment of the semi-rotary accumulator illustrated in FIG. 1 and further illustrate motion of the movable idlers shafts within the semi-rotary accumulator. These figures illustrate a schematic side view of the accumulator to illustrate the relative positions of the first idler shaft 102, the second idler shaft 104, the third idler shaft 106, and the fourth idler shaft 108, and to further illustrate the motion of the first and second movable idler shafts 110 and 112. A first web path may travel from the first idler shaft 102 past the first movable idler shaft 110 and to the second idler shaft 104. A second web path may travel from the third idler shaft 106 past the second movable idler shaft 112 and to the fourth idler shaft 108. The first and second movable idler shafts 110 and 112 move together in concert as they are they are connected (e.g. second linkage 126 illustrated in FIGS. 7A-C). Simultaneous movement of the first movable idler shaft 110 toward the first axis position and the second movable idler shaft toward the third axis position (e.g. FIG. 7C) increases a length of the first web path between the first and second idler shafts 102 and 104 and decreases a length of the second web path between the third and fourth idler shafts 106 and 108. Simultaneously movement of the first movable idler shaft 110 toward the second axis position and the second movable idler shaft 112 toward the fourth axis position (e.g. FIG. 7A) decreases the length of the first web path between the first and second idler shafts 102 and 104, and increases the length of the second web path between the third and fourth idler shafts 106 and 108. The position of the axes are designed to cause the web length changes to be complementary. That is, the increase in the length of the first web path corresponds to the decrease in the length of the second web path, and the decrease in the length of the first web path corresponds to the increase in the length of the second web path. The idler shafts 102, 104, 106, 108 may have fixed axes to avoid introducing additional inertia into the web. However, a system may be designed to provide the complementary web length changes using non-fixed axes. Furthermore, the diameter of the idler shafts is not intended to limit the scope of the present subject matter. Larger diameter idler shafts, such as illustrated in use with the first web path, may be used when the web has product on it to avoid damaging the product or causing the product to release from the web, for example. In the second web path, for example, the web may no longer have the product, such that smaller idler shafts may be used.

Figure 8:
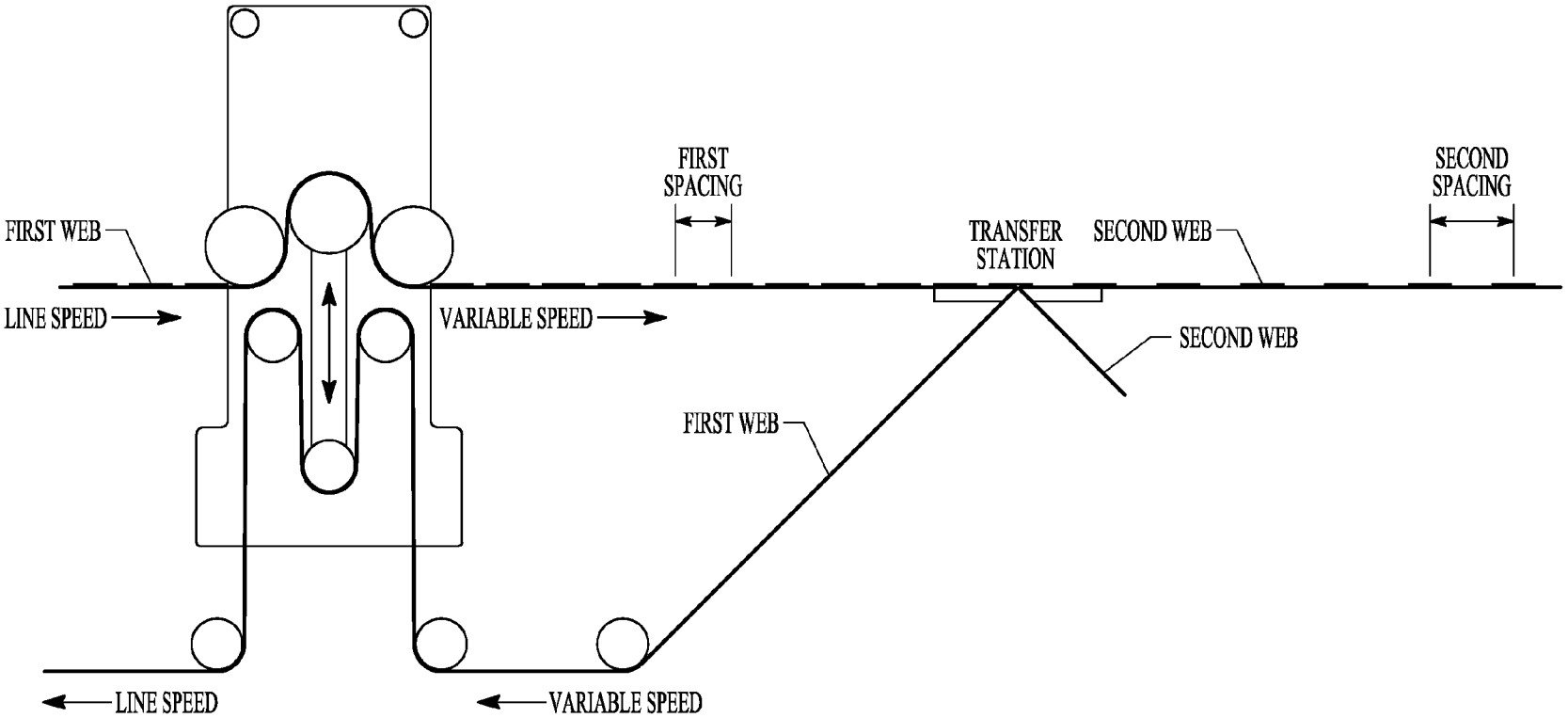
FIG. 8 illustrates the embodiment of a system that includes a semi-rotary accumulator with a part transfer station.

FIG. 8 illustrates the embodiment of a system that includes a semi-rotary accumulator with a part transfer station. The illustrated system includes a first web and a second web. Parts are transferred from the first web to the second web at the transfer station. For example, parts may be lightly adhered to the first web as it passes through the first web pass of the accumulator toward the transfer station. At the transfer station, the first web is pulled at a sharp angle, such that the parts detach from the first web and continue in a straight line onto the second web. The illustrated system may be used to change the spacing between parts. For example, the spacing between parts is closer on the first web than the spacing of parts on the second web.

The first web may enter the first web path of the accumulator at line speed, and exits the second web path of the accumulator at line speed. However, operation of the accumulator causes the speed of the web to vary at the transfer station. The speed of the first web may match the speed of the second web during the part transfer. However, in order to increase the spacing between parts on the second web, the first web may temporarily decrease in speed between part transfers, may temporarily stop between part transfers, and/or may temporarily reverse directions between part transfers.

Figure 9A:
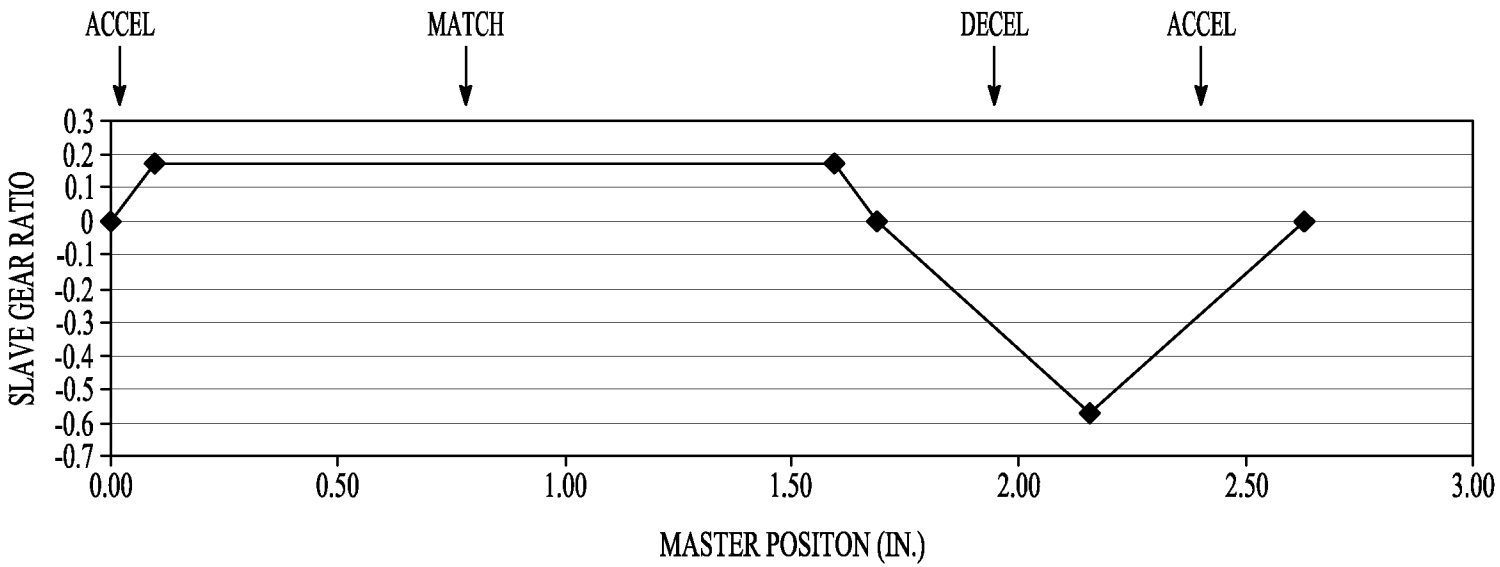
FIGS. 9A-9B illustrate an example of a Position CAM (PCAM) profile for controlling motion of the semi-rotary accumulator to place parts on the part transfer station illustrated in FIG. 8, where FIG. 9A plots a slave gear ratio against a master position in inches, and where FIG. 9B plots a slave position against a master position in motor counts.
Figure 9B:
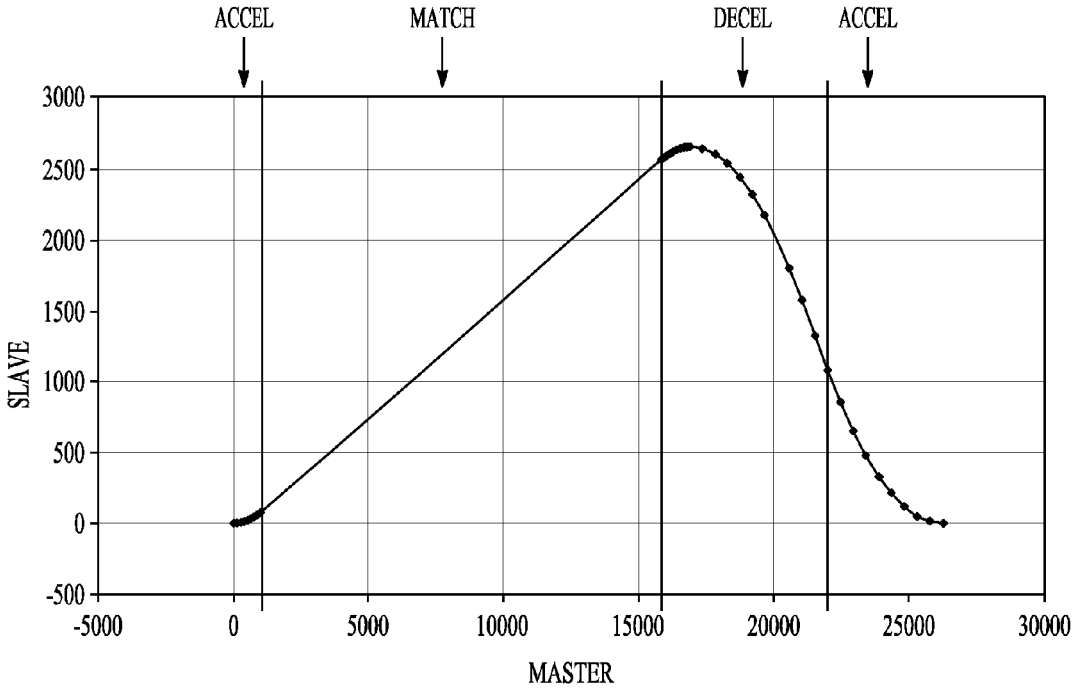

FIG. 9A illustrates an example of a Position CAM (PCAM) profile for controlling motion of the semi-rotary accumulator to place parts on the part transfer station illustrated in FIG. 8. The PCAM profile illustrates the acceleration of the first web speed until the first web matches the speed of the web. After the web speed matches, the part is placed. After the part is placed, the first web is decelerated for a time to increase the part space on the second web, and then accelerated again to repeat the profile. The PCAM profile is described illustrated units of length (e.g. inches). A user may input values to control the motion during the PCAM profile, including the part-to-part spacing ("Pre Accumulator Length) of the first web, the part-to-part spacing ("Post Accumulator Length) of the second web, and the part length ("Match Length). The lengths on the bottom of FIG. 9 are based on the part-to-part spacing on the first web, the part-to part spacing on the second web, and the part length. The gear ratio of the first web may be slaved off of the gear ratio of the second web. Thus, "match" being at 0.0937 inches, deceleration begins at 1.5937 inches, etc. FIG. 9B illustrates, using motor counts, the relationship between master and slave throughout the PCAM profile. The master is the same as the master in FIG. 9A, but in motor counts rather than inches. The slave represents the position of the movable idlers shafts throughout the cam profile. The linear portion represents the "Match" portion of the profile where the slave gear ratio is constant, the concave up portion represents the acceleration portion of the profile where the slave gear ratio is increasing, and the concave down portion represents the deceleration portion of the profile where the slave gear ratio is decreasing.

Figure 10:
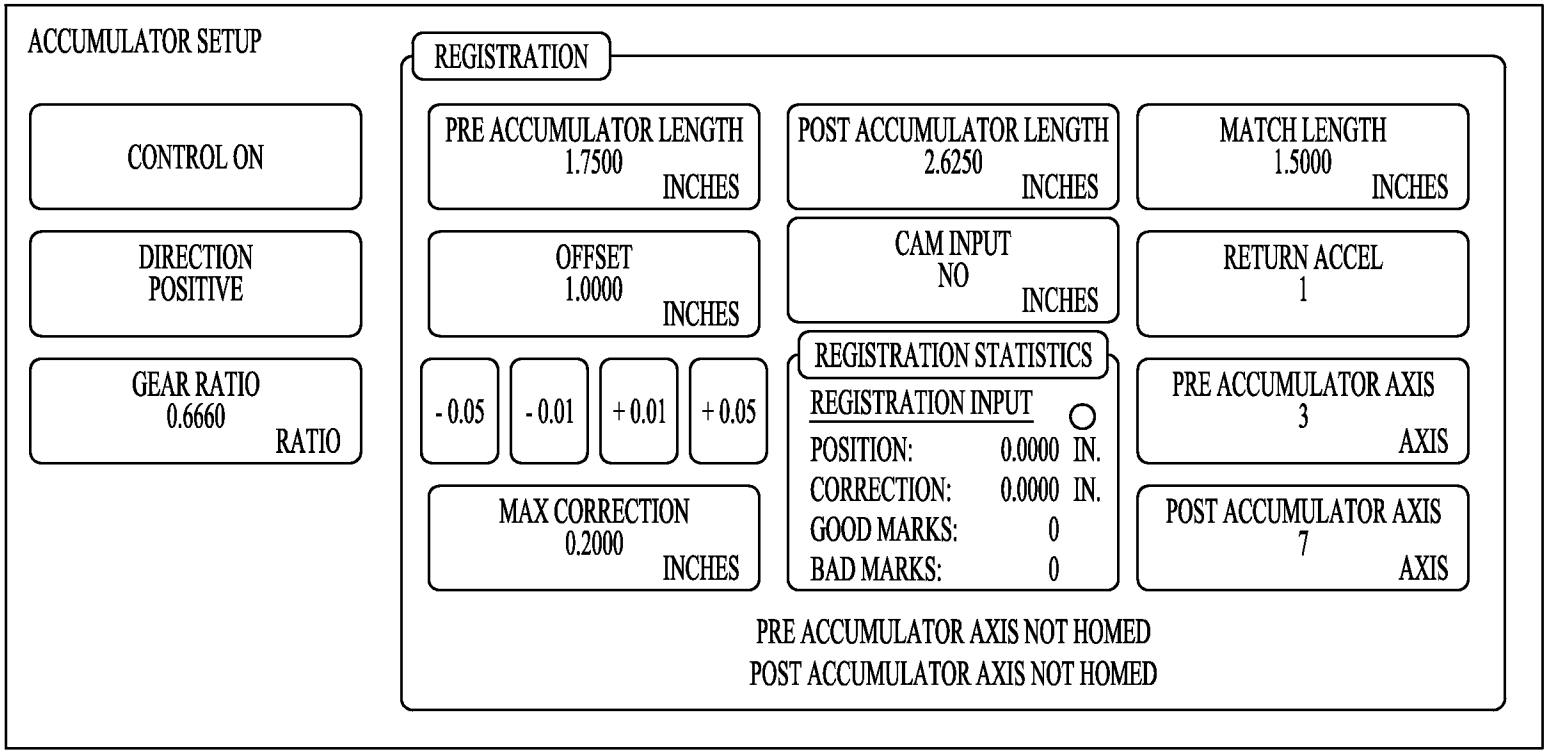
FIG. 10 illustrates an embodiment of a user interface to program the PCAM profile.

FIG. 10 illustrates an embodiment of a user interface to program the PCAM profile. In the illustrated embodiment, a user may select whether to turn on the accumulator using the Control On" button. Also, as servo motors may be used, the user can program a gear ratio. The pre-accumulator length, post-accumulator length and match length may be entered, as well as a maximum correction and offset to maintain registration during the part transfer. The user may also program the axis on the web processing system to be used to monitor pre-accumulator and post accumulator.

Figure 11:
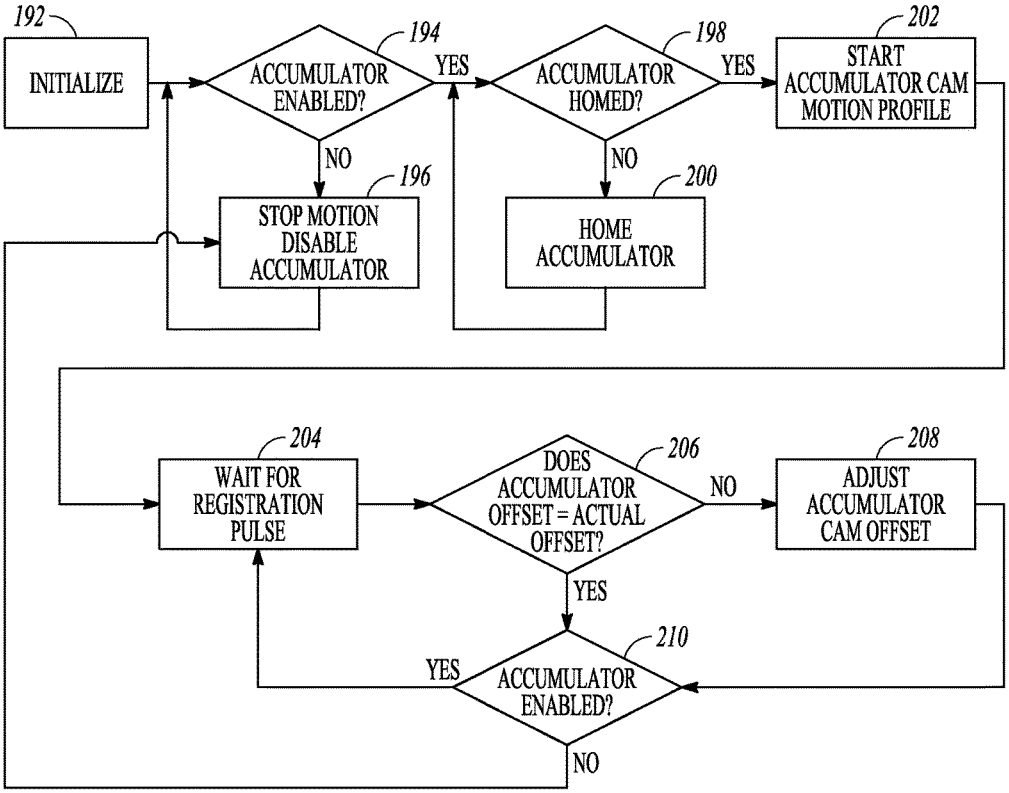
FIG. 11 is an embodiment of a method for operating the semi-rotary accumulator.

FIG. 11 is an embodiment of a method for operating the semi-rotary accumulator. The system is initialized at 192, and a check is performed to determine if the system has enabled the accumulator at 194. If the accumulator is not enabled then the motion is stopped and the accumulator is disabled 196. If the accumulator is enabled, then a check is performed to determine whether the accumulator is homed 198. The accumulator is homed at 200 if not already homed. If the accumulator is homed, then the cam profile is started 202, and the accumulator waits for a registration pulse 204 from the system. In response to a received registration pulse, a check is performed to determine if the accumulator offset equals the actual offset 206. If the offsets are not equal, then the accumulator adjusts the accumulator cam offset 208, and then performs a check to determine if the system has enabled the accumulator at 210. If the accumulator is enabled at 210, then the process returns to 204 to wait for a registration pulse. If the accumulator is not enabled at 210, then the process returns to 196 to stop motion and disable the accumulator.

The methods illustrated in this disclosure are not intended to be exclusive of other methods within the scope of the present subject matter. Those of ordinary skill in the art will understand, upon reading and comprehending this disclosure, other methods within the scope of the present subject matter. The above-identified embodiments, and portions of the illustrated embodiments, are not necessarily mutually exclusive. These embodiments, or portions thereof, can be combined. In various embodiments, the methods are implemented using a sequence of instructions which, when executed by one or more processors, cause the processor(s) to perform the respective method. In various embodiments, the methods are implemented as a set of instructions contained on a computer-accessible medium such as a magnetic medium, an electronic medium, or an optical medium.

The above detailed description is intended to be illustrative, and not restrictive. Other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method, comprising moving a first web through an accumulator to a station, returning the first web from the station through the accumulator, wherein moving the first web includes moving the first web at line speed to the accumulator, converting the line speed of the first web to variable speed using a first accumulator path through the accumulator, moving the first web at the variable speed from the accumulator to the station, moving the first web at the variable speed from the station to the accumulator, converting the variable speed of the first web to the line speed using a second accumulator path through the accumulator, and moving the web from the accumulator at the line speed, wherein moving the first web at the variable speed includes for each of a plurality of time periods:

moving the first web at a constant speed for a duration of time in the time period to allow a programmable length of the first web to pass the station at the constant speed, the constant speed being different than the line speed; and varying the speed of the first web during a remainder of the time period to compensate for moving the first web for the duration of time at the constant speed that is different than the line speed.

2. The method of claim 1, wherein the accumulator includes a first idler shaft a second idler shaft, a third idler shaft, a fourth idler shaft, a first movable idler shaft and a second movable idler shaft, wherein moving the first web includes weaving the first web through the first accumulator path between the first idler shaft, the first movable idler shaft, and the second idler shaft in a travel path to the station, and weaving the first web through the second accumulator path between the third idler shaft, the second movable idler shaft, and the fourth idler shaft in a travel path from the station.

3. The method of claim 2, further comprising simultaneously moving the first and second movable idler shafts to simultaneously convert the line speed of the first web to the variable speed using the first accumulator path and convert the variable speed of the first web to the line speed using the second accumulator path.

4. The method of claim 3, wherein a linkage links together the first and second movable idler shafts, and simultaneously moving the first and second movable idler shafts includes operating a motor operably connected to the linkage to simultaneously move the first and second movable idler shafts.

5. The method of claim 3, wherein simultaneously moving the first and second movable idler shafts includes using a first linear bearing rail on a first end of the movable idler shafts and a second linear bearing rail on a second end of the movable idler shafts to simultaneously move the first and second movable idler shafts.

6. The method of claim 3, wherein simultaneously moving the first and second movable idler shafts includes moving the first movable idler shaft between a first and a second axis position, and moving the second movable idler shaft between a third and a fourth axis position, wherein a distance between the first and the second axis positions is the same as a distance between the third and the fourth axis positions.

7. The method of claim 1, wherein the first accumulator path through the accumulator extends between the first and second idler shafts, the second accumulator path through the accumulator extends between the third and fourth idler shafts, converting the line speed to the variable speed using the first accumulator path includes changing a length of the first accumulator path extending between the first and second idler shafts, and converting the variable speed of the first web to the line speed using the second accumulator path includes changing a length of the second accumulator path extending between the third and fourth idler shafts.

8. The method of claim 1, wherein changing the length of the first accumulator path and changing the length of the second accumulator path includes simultaneously increasing the length of the first accumulator path extending between the first and second idler shafts while decreasing the length of the second accumulator path extending between the third and fourth idler shafts, and simultaneously decreasing the length of the first accumulator path extending between the first and second idler shafts while increasing the length of the second accumulator path extending between the third and fourth idler shafts.

9. A method, comprising moving a first web through an accumulator to a station, returning the first web from the station through the accumulator, wherein moving the first web includes moving the first web at line speed to the accumulator, converting the line speed of the first web to variable speed using a first accumulator path through the accumulator, moving the first web at the variable speed from the accumulator to the station, moving the first web at the variable speed from the station to the accumulator, converting the variable speed of the first web to the line speed using a second accumulator path through the accumulator, and moving the web from the accumulator at the line speed, wherein:

changing the length of the first accumulator path and changing the length of the second accumulator path includes simultaneously increasing the length of the first accumulator path extending between the first and second idler shafts while decreasing the length of the second accumulator path extending between the third and fourth idler shafts, and simultaneously decreasing the length of the first accumulator path extending between the first and second idler shafts while increasing the length of the second accumulator path extending between the third and fourth idler shafts; and simultaneously increasing the length of the first accumulator path while decreasing the length of the second accumulator path includes increasing the length of the first accumulator path extending between the first and second idler shafts to a long length for the first path and decreasing the length of the second accumulator path extending between the third and fourth idler shafts to a short length for the second accumulator path, simultaneously decreasing the length of the first accumulator path while increasing the length of the second accumulator path includes decreasing the length of the first accumulator path extending between the first and second idler shafts to a short length for the first accumulator path and increasing the length of the second accumulator path extending between the third and fourth idler shafts to a long length for the second accumulator path, and the long length for the first accumulator path is equal to the long length for the second accumulator path, and the short length for the first accumulator path is equal to the short length for the second accumulator path.

10. The method of claim 1, wherein each idler shaft is configured to freely rotate about its respective axis when a web passes in contact with the idler shaft.

11. The method of claim 10 wherein each of the first, second, third and fourth idlers shafts have fixed positions.

12. The method of claim 1, wherein the station is a part transfer station, and wherein moving the first web through the accumulator to the station includes moving parts spaced along the first web to the station, the method further comprising moving a second web through the part transfer station, and transferring parts from the first web moving through the station at a variable speed to the second web moving through the station.

13. The method of claim 12, further comprising implementing a programmed cam profile to control simultaneous movement of the first and second movable idler shafts to control part spacing on the second web.

14. A system, comprising;

an accumulator and a station, wherein the accumulator has a first accumulator path through the accumulator and a second accumulator path through the accumulator wherein the system is configured to automatically:

move a first web at line speed to the accumulator, move the first web through the first accumulator path and convert the line speed to variable speed using the accumulator, move the first web from the accumulator at the variable speed to the station, move the first web at the variable speed to return the first web from the station to the accumulator, move the first web through the second accumulator path and convert the variable speed to the line speed using the accumulator, and move the first web away from the accumulator at the line speed, wherein the system is configured to, for each of a plurality of time periods, automatically move the first web at the variable speed by:

moving the first web at a constant speed for a duration of time in the time period to allow a programmable length of the first web to pass the station at the constant speed, the constant speed being different than the line speed; and varying the speed of the first web during a remainder of the time period to compensate for moving the first web for the duration of time at the constant speed that is different than the line speed, wherein the accumulator includes a first idler shaft a second idler shaft, a third idler shaft, a fourth idler shaft, a first movable idler shaft and a second movable idler shaft, wherein the first accumulator path passes by the first idler shaft, the first movable idler shaft and the second idler shaft, and the second accumulator path passes by the third idler shaft, the second movable idler shaft and the fourth idler shaft.

15. The system of claim 14, wherein the first movable idler shaft has first and second ends and a first movable axis that extends between the first and second ends, the first movable axis being movable between a first axis position and a second axis position, and the second movable idler shaft has first and second ends and a second movable axis that extends between the first and second ends, the second movable axis being movable between a third axis position and fourth axis position.

16. The system of claim 15, further comprising a first linkage connecting the first end of the first movable idler shaft to the first end of the second movable idler shaft and a second linkage connecting the second end of the first movable idler shaft to the second end of the second movable idler shaft, and a motor linkage configured to connect the at least one linkage to at least one motor for providing simultaneous movement of the first and second movable idler shafts.

17. The system of claim 16, further comprising linear bearings configured to help move the first and second movable idler shafts.

18. The system of claim 14, wherein each idler shaft is configured to freely rotate about its respective axis when a web passes in contact with the idler shaft.

19. The system of claim 14, wherein each of the first, second, third and fourth idlers shafts have fixed positions.

* * * * *